US006422897B1

(12) United States Patent
Odorfer

(10) Patent No.: US 6,422,897 B1
(45) Date of Patent: Jul. 23, 2002

(54) SHORTING CONTACT SUPPORT FOR A PLUG-IN PROJECTION IN AN IGNITER RECEPTACLE

(75) Inventor: Frank Odorfer, Nuremberg (DE)

(73) Assignee: Framatone Connectors International, Courbevoie (FR)

( * ) Notice: Subject to any disclaimer, the term of this patent is extended or adjusted under 35 U.S.C. 154(b) by 0 days.

(21) Appl. No.: 09/628,762

(22) Filed: Jul. 31, 2000

(30) Foreign Application Priority Data

Aug. 5, 1999 (DE) ..... 199 36 848

(51) Int. Cl.[7] ..... H01R 31/08; H01R 29/00
(52) U.S. Cl. ..... 439/510; 439/188
(58) Field of Search ..... 439/188, 510, 439/507, 511, 513

(56) References Cited

U.S. PATENT DOCUMENTS 3,903,385 A * 9/1975 Moyer et al. ..... 200/51.1
5,007,851 A * 4/1991 Matsumoto ..... 439/188
5,145,391 A * 9/1992 Alwine ..... 439/188
5,944,547 A * 8/1999 Golab et al. ..... 439/188
6,062,885 A * 5/2000 White ..... 439/188
6,077,104 A * 6/2000 Chang et al. ..... 439/489
6,077,126 A * 6/2000 Peng ..... 439/668
6,099,334 A * 8/2000 Togashi ..... 439/188
6,135,809 A * 10/2000 Asakawa ..... 439/489
6,155,854 A * 12/2000 Chen ..... 439/188
6,162,078 A * 12/2000 Chung ..... 439/188
6,171,124 B1 * 1/2001 Kojima ..... 439/188

FOREIGN PATENT DOCUMENTS

DE 19728448 C1 9/1998

* cited by examiner

*Primary Examiner*—P. Austin Bradley
*Assistant Examiner*—Edwin A. León
(74) *Attorney, Agent, or Firm*—Perman & Green, LLP

(57) ABSTRACT

A shorting contact support for a plug-in projection (5*c*) in an igniter receptacle, comprising a first shorting bridge (30*a*) having two resilient contact elements (35*a*, 36*a*) connected to one another by an edge (37) of a metal plate (31), and a support housing (9) having an annular base (2) on which two diametrically opposite wings (3, 4) are integrally formed parallel to the insertion direction and form a holder (5) for a plug (6) having sockets (51, 52) for the insertion of contact pins (21, 22) on an igniter receptacle (20). The shorting contact support has a second shorting bridge (30*b*) which is essentially identical to the first shorting bridge (30*a*), each wing (3, 4) containing a shorting bridge (30*a*, 30*b*), so that at least one bridge (30*a*, 30*b*) shorts the two contact pins (21, 22) arranged in one plane on the igniter receptacle (20) when the plug (6) is inserted. In addition, the holder (5) is rotationally symmetrical through 180°.

7 Claims, 4 Drawing Sheets

SHORTING CONTACT SUPPORT FOR A PLUG-IN PROJECTION IN AN IGNITER RECEPTACLE

BACKGROUND OF THE INVENTION

1. Field of the Invention

The invention relates to a shorting contact support for a plug-in projection in an igniter receptacle.

2. Description of Prior Developments

Such shorting contact supports are used, in particular, in airbag ignition systems in order to short the contact pins on the igniter receptacle so that the ignition cartridge is in no way able to reach an undefined potential, with the result that unintentional ignition of the ignition cartridge is effectively prevented. In this context, it is important for the shorting bridge between the contact pins to be opened when the plug is inserted or secondarily locked in the shorting contact support.

The document DE 197 28 448, incorporated herein by reference, has disclosed a plug connector for connection to an igniter receptacle, having a plug-in projection, locking arms and a plug body secured by a bar-like secondary locking mechanism with tongues running parallel to locking arms. Furthermore, this secondary locking mechanism has a spike which opens the shorting bridge between the contact pins of the igniter when the plug is secured in the contact support. The plug-in projection on the plug and the complementary holder in the contact support are of asymmetrical design, so that they can both be inserted with only one orientation. The shorting contact support can likewise be inserted into the igniter receptacle with one orientation.

By way of example, such shorting contact supports are used in side airbag ignition systems. FIG. 7 shows a plan view of a motor vehicle 1 having three modules 72, 73 and 74 mounted close to the door. A module should be understood in this case to mean a gas generator having, by way of example, an ignition receptacle, an igniter and a primer 79 for an airbag. When a first module 72 is installed on the right-hand side of the motor vehicle, the manufacturer requires the outgoing cables from the plug 75 to be always directed towards the rear, for example, or else the primer 79 should always point into the interior of the car. If the identical module is to be used for the left-hand side, this module needs to be rotated through 180° so that the mounting plate 78 always points outwards, for example, and the primer 79 always points inwards. When the module 72 is rotated, the ignition receptacle of the module is naturally also rotated through 180° as well, although the antireversal shorting contact support means that the plug 76 can then be inserted only in such a way that the outgoing cable points towards the front, as can be seen with regard to module 73. Thus, a particular disadvantage of such shorting contact supports is that, when installing the side airbag, the manufacturer requires two different modules with ignition receptacles rotated through 180° for the two sides of the motor vehicle, or else two different shorting contact supports, one for the left-hand side and one for the right-hand side, so that the outgoing cable for the plug 77 also points in the same direction for the other (left-hand) side of the motor vehicle, as shown for module 74, for example.

SUMMARY OF THE INVENTION

The object of the invention is to eliminate the aforementioned disadvantages without increasing the number of components required for an airbag ignition system.

The above object of the present invention is achieved by a shorting contact support for a plug-in projection in an igniter receptacle, comprising a first shorting bridge having two resilient contact elements connected to one another by means of an edge of a metal plate, and a support housing having an annular base on which two diametrically opposite wings are integrally formed parallel to an insertion direction and form a holder for a plug having sockets for the insertion of contact pins on an igniter receptacle, the shorting contact support having a second shorting bridge which is essentially identical to the first shorting bridge, each wing containing one of the shorting bridges, so that at least one bridge shorts the contact pins which are arranged in one plane on the igniter receptacle when the plug is inserted, and wherein the holder is rotationally symmetrical through 180°.

In accordance with preferred embodiments of the present invention the wings are enveloped by a cylinder shape, a respective lobe being integrally formed on the free ends of the wings on the outside; the wings each have an inwardly directed guide shoulder running parallel to the insertion direction in the center; the contact elements run from the top edge to the bottom edge of the metal plate which is essentially rectangular and at a slight distance from the plate; a central region of the contact elements runs essentially parallel to the plate, and an end region of the contact elements runs essentially transversely with respect to the insertion direction, and the contact elements each have, between the central region and the end region, a corner directed away from the metal plate; bridges are arranged with mirror-image symmetry with respect to one another in the wings; and the shorting contact support comprises part of a plug connector with an igniter for a restraining system in a motor vehicle.

DESCRIPTION OF THE DRAWINGS

The invention is explained in more detail below with the aid of the description of an illustrative embodiment with reference to the drawing, in which.

DETAILED DESCRIPTION OF THE PREFERRED EMBODIMENTS

Figure 1:
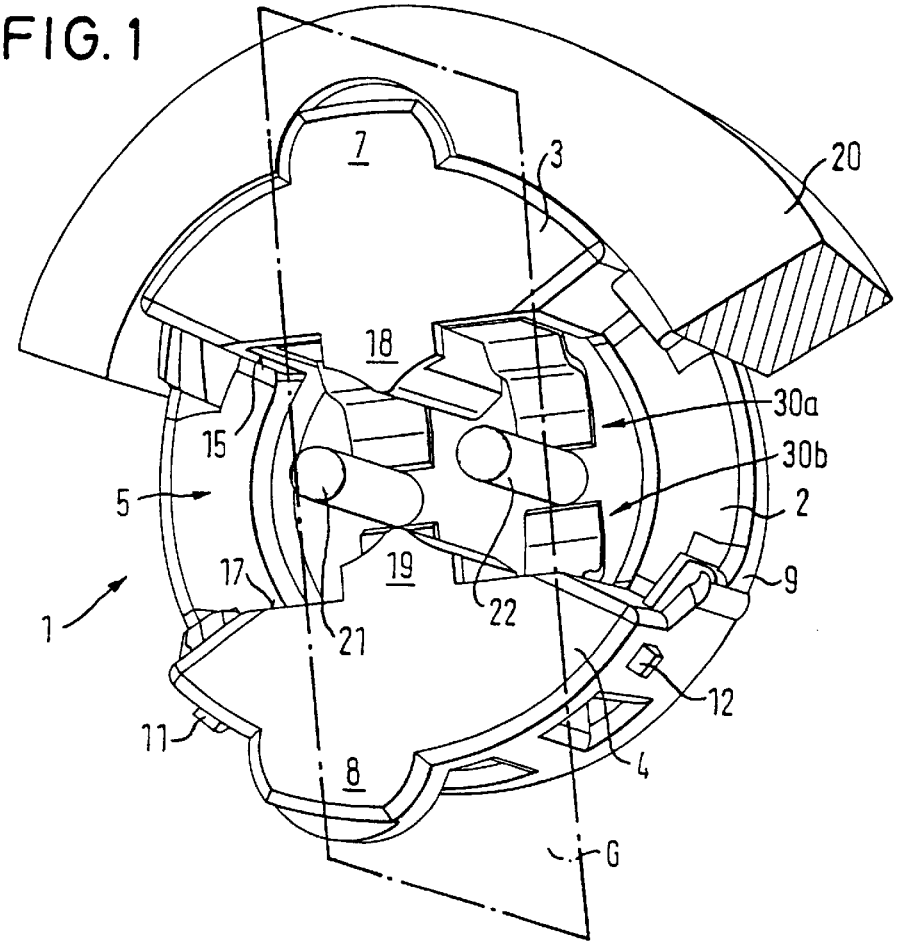
FIG. 1 shows the front of an inventive shorting contact support inserted into a cut-away igniter receptacle.
Figure 2:
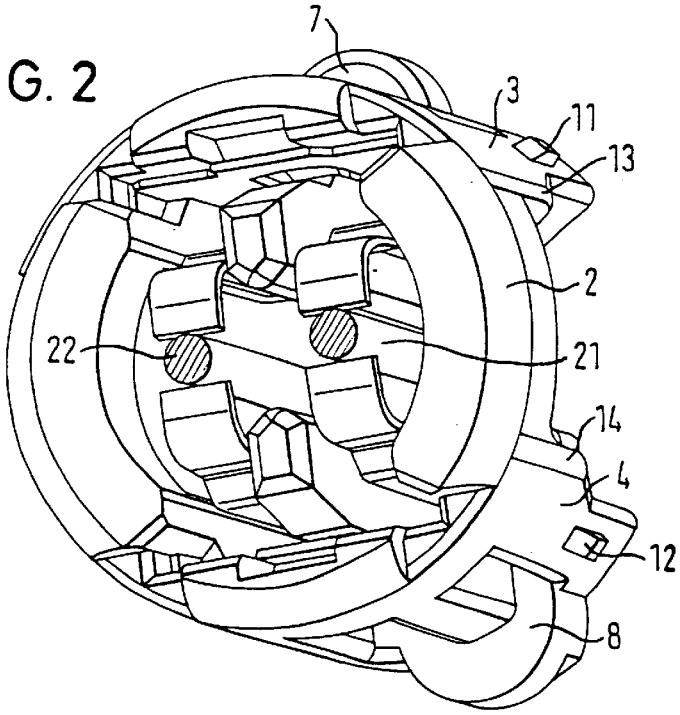
FIG. 2 shows the back of the inventive shorting contact support shown in FIG. 1.

An oblique plan view of an inventive shorting contact support can be seen in FIG. 1 from the front and in FIG. 2 from the back. The shorting contact support 1 has a non-conductive support housing 9 having an annular base 2 on which two diametrically opposite wings 3 and 4 are integrally formed parallel to the insertion direction and form a holder 5 for a plug 6. The support housing 9 is bounded by a cylindrical circumferential surface, and, from this circumferential surface, a respective lobe 7 and 8 for coding purposes is integrally formed outwards on the front of the wings at right angles to the insertion direction. For coding purposes, the essentially semicircular lobes 7 and 8 are arranged such that they are not diametrically opposite. Furthermore, the cylindrical circumferential surface has protruding latching lugs 11 and 12 which are able to latch into corresponding cutouts made in the igniter receptacle 20. In addition, guide lugs 13 and 14 running in the insertion direction are integrally formed on the cylindrical circumferential surface. The essentially rectangular holder 5 is framed by the surfaces 15 and 17 (running parallel to the insertion direction) of the wings 3 and 4, with guide shoulders 18 and 19 which project. into the holder 5 and run parallel to the insertion direction being integrally formed on these surfaces 15 and 17. These guide shoulders must be situated exactly in the centre of the surfaces 15 and 17 so that the holder 5 is rotationally symmetrical through 180°.

Figure 4:
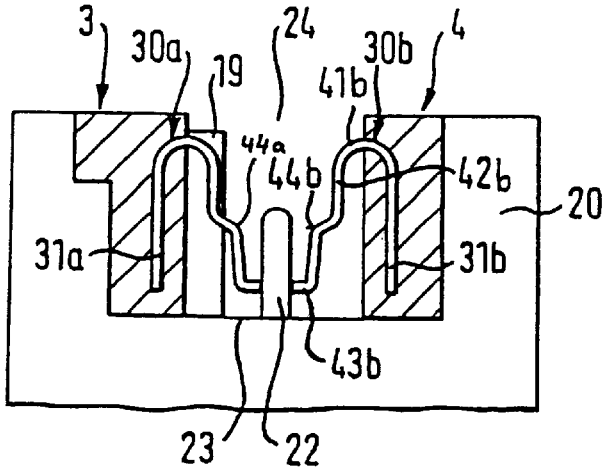
FIG. 4 shows a section along the plane G through the inventive shorting contact support shown in FIG. 1.

As can be seen in FIG. 4, the igniter receptacle 20 shown in FIG. 1 has two contact pins 21 and 22 which run in the plug-in direction, lie in one plane and project from the bottom of the cylindrical opening 24 for holding the shorting contact support 1. This opening 24 made in the igniter receptacle 20 has complementary cutouts on its front for the lobes 7 and 8.

Figure 3:
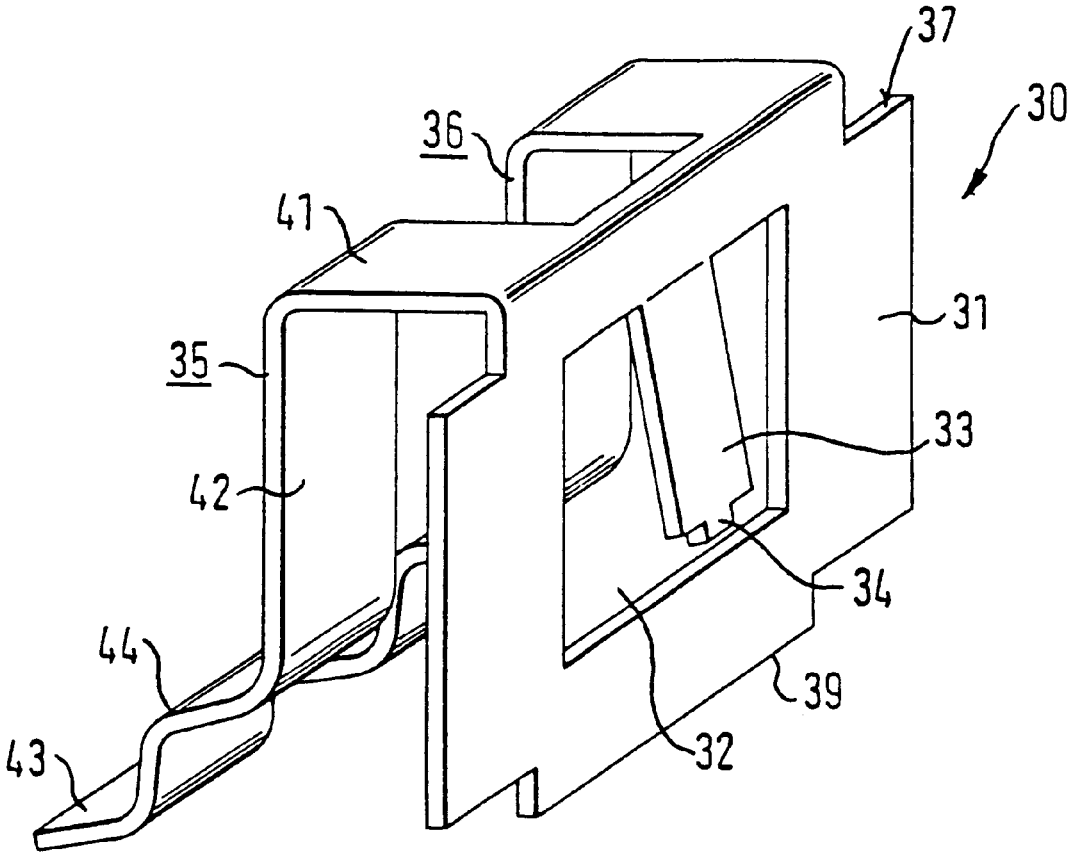
FIG. 3 shows an oblique side view of an inventive shorting bridge.

FIG. 3 shows a perspective illustration of a shorting bridge 30 having an essentially rectangular metal plate 31 with an essentially rectangular window 32 cut out of it, in which a finger 33 which is directed outwards in the insertion direction and has a shoulder 34 is integrally formed in the top edge of the window. In addition, two inwardly directed contact elements 35 and 36 are integrally formed on the top edge 37 of the metal plate 31. Each contact element 35, 36 comprises a starting region 41 integrally formed on the front edge 37 of the metal plate 31 and at right angles thereto, a central region 42 extending the starting region at right angles thereto and parallel to the metal plate 31, and an end region 43 running essentially at right angles to the metal plate 31, the central region 42 being connected to the end region 43 by means of a corner 44 pointing away from the plate 31.

FIG. 4 shows a section along the plane G of the shorting contact support 1 situated in the igniter receptacle 20. In this case, the sectional plane runs at right angles to the metal plate 31 of the shorting bridge 30, so that this shorting bridge 30 can be seen only from the side in this figure. The shorting contact support 1 additionally contains a shorting bridge 30*a* and 30*b* in each wing 3 and 4, said shorting bridges being arranged such that the two metal plates 31*a* and 31*b* are arranged parallel to and in the wings 3 and 4. In this arrangement, the contact elements 35 and 36 project into the holder 5, the central regions 42 of these contact elements 35, 36 being directed downwards onto the plane which passes through the base 2, so that the end region 43 runs parallel to this plane, The two shorting bridges are arranged with mirror-image symmetry with respect to the plane which passes through the contact pins 21 and 22. As can be seen in FIG. 4, a contact pin 22 is touched by a respective contact element of one shorting bridge 30*a* and by the other shorting bridge 30*b*. FIGS. 1 and 2 also clearly show that the contact pins 21 and 22 are each touched by two contact elements, the top contact element belonging to the top shorting bridge 30*a* and the bottom contact element belonging to the bottom shorting bridge 30*b*. This ensures that the two contact pins 21 and 22 are shorted both by one shorting bridge 30*a* and by the other shorting bridge 30*b*.

Figure 5:
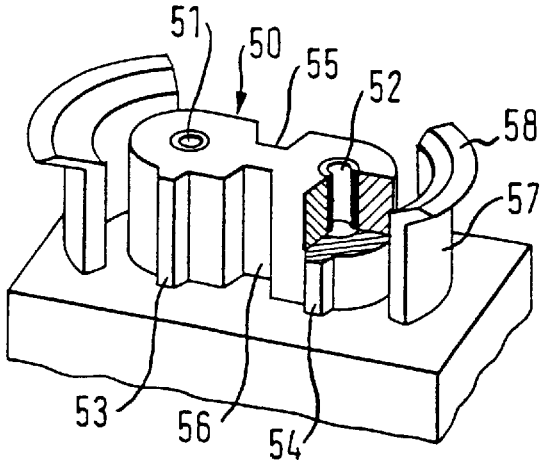
FIG. 5 shows a perspective illustration of a partially cut-away plug-in projection.
Figure 7:
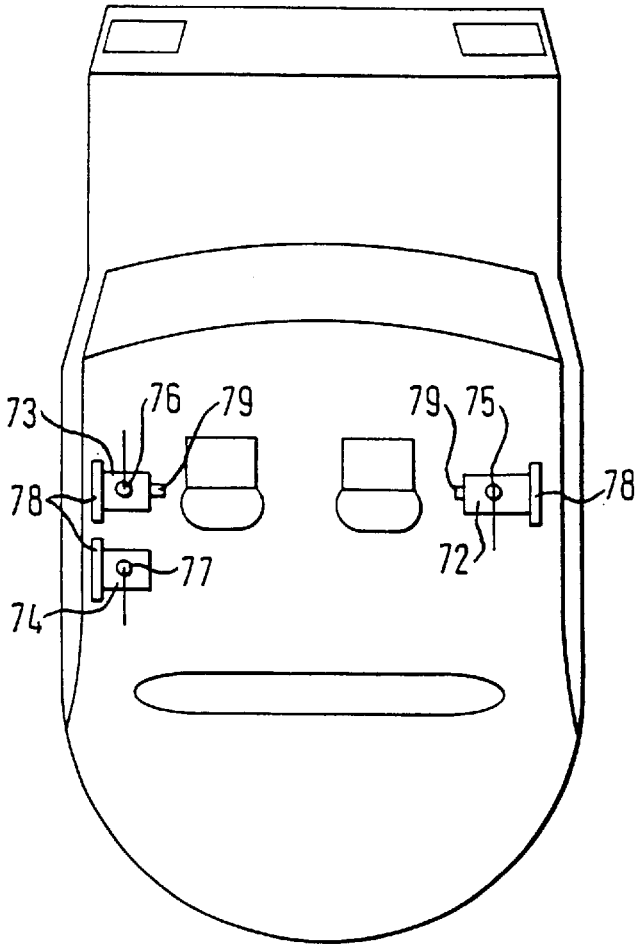
FIG. 7 shows a plan view of a motor vehicle having side-mounted modules.

FIG. 5 shows a partially cut-away plug-in projection on the plug 6. The essentially rectangular plug-in projection 50, extending in the plug-in direction, has two sockets 51 and 52 for holding the contact pins 21 and 22. Two grooves 55 and 56 for accommodating the guide shoulders 18 and 19 are made in the lateral length surfaces of the plug-in projection 50, in the plug-in direction. These grooves are situated exactly in the centre of the lateral length surfaces of the plug-in projection 50 so that said plug-in projection can be inserted into the holder when rotated through 180°. A respective shoulder 53 and 54 is integrally formed, running in the plug-in direction, on one side of the length surfaces at the height of the sockets, so that the left-hand half of the plug-in projection is mirror-image symmetrical with respect to the right-hand half of the plug-in projection, the mirror plane passing through the two grooves 55 and 56. A latching arm 57 with a latching lug 58 for latching into the igniter receptacle 20 is integrally formed on each width side of the plug-in projection 50.

A brief description of an example of use is given below.

During assembly of a side airbag, a shorting contact support 1 is first inserted into the ignition receptacle 20, with one shorting bridge 30*a* and the other shorting bridge 30*b* shorting the two contact pins 21 and 22 on the igniter receptacle 20. Next, the plug-in projection 50 on the plug shown in FIG. 6 is inserted into the holder 5, and one shorting bridge, for example 30a, is lifted from the contact pins 21 and 22 by-the shoulders 53 and 54 on the plug-in projection 50, so that the two contact pins are now shorted only by a single shorting bridge 30*b*.

Figure 6:
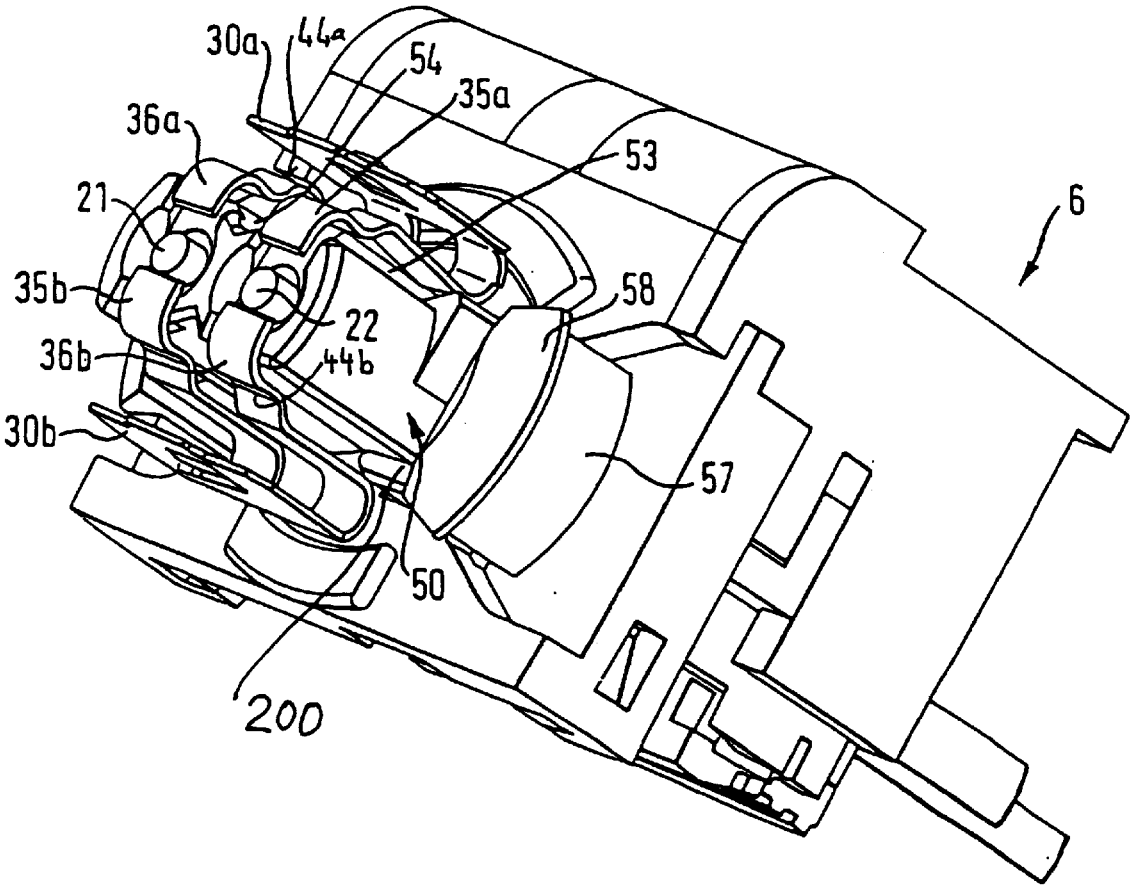
FIG. 6 shows a perspective view of a plug having two shorting bridges located on the plug-in projection.

FIG. 6 shows an oblique plan view of the plug 6 with the plug-in projection 50, the two shorting bridges 30*a* and 30*b* of the shorting contact support 1 being shown individually. It should be noted that the lower-case letters "a" and "b" have been introduced to distinguish the two shorting bridges and their associated elements. Thus, for example, the shorting bridge 30*a* is situated in the wing 3 and the shorting bridge 30*b* is situated in the wing 4. When the plug-in projection 50 is inserted into the holder 5, the guide shoulders 18 and 19 enter the grooves 55 and 56. As the plug-in projection is inserted further, the shoulders 53 and 54 approach the two corners 44*a* of the two contact elements 35*a* and 36*a* of the shorting bridge 30*a* (see FIG. 5). As these corners 44*a* are overcome, the contact elements 35*a* and 36*a* are accordingly removed from the contact pins 21 and 22. Since there are no such shoulders 53, 54 on the other length side of the plug-in projection 50, the contact elements 35*b* and 36*b* remain touching the contact pins 21 and 22, so that the latter are still shorted. If, instead of this, the plug-in projection is inserted rotated through 180°, the shorting bridge 30*b* is removed instead of the contact bridge 30*a*. Only during secondary locking by means of a bar with a spike 200, for example, is one of the two contact elements 35*b* and 36*b* which is still in contact removed from a contact pin 21 or 22. In this case, this spike slides between the plug-in projection 50 and the contact element 35*b* or 36*b* which is to be raised, and the spike then descends below the corner 44*b* and raises the element accordingly.

The plug connector is consequently locked and activated, i.e. the primer would be ready for use.

I claim:

1. Shorting contact support for a plug-in an igniter receptacle wherein a plug has a plug in projection surrounding socket contacts, the plug in projection comprising at least one shoulder for lifting at least one resilient contact element of a shorting bridge upon insertion of the plug in projection between diametrically opposite wings, comprising a first shorting bridge having two resilient contact elements connected to one another by means of an edge of a metal plate, and a support housing having an annular base on which two diametrically opposite wings are integrally formed parallel to an insertion direction and form a holder for a plug having sockets for the insertion of contact pins on an igniter receptacle the shorting contact support having a second shorting bridge which is essentially identical to the first shorting bridge, each wing containing one of the shorting bridges, so that at least one bridge shorts the contact pins which are arranged in one plane on the igniter receptacle when the plug is inserted, and wherein the holder is rotationally symmetrical through 180°, the second shorting bridge having at least one second resilient contact element lifted out of contact from one of the pins by a spike part of a secondary locking device.

2. Shorting contact support according to claim 1, wherein the wings are enveloped by a cylinder shape, a respective lobe being integrally formed on the free ends of the wings on the outside said lobe being received in a complementary recess of said receptacle.

3. Shorting contact support according to claim 1, wherein the wings each have an inwardly directed guide shoulder running parallel to the insertion direction in the center said guide shoulder being received in a groove of said plug in projection upon insertion of said plug in projection between said wings.

4. Shorting contact support according to claim 1, wherein the contact elements run from the top edge to the bottom edge of the metal plate which is essentially rectangular and at a slight distance from the plate.

5. Shorting contact support according to claim 1, wherein a central region of the contact elements runs essentially parallel to the plate, and an end region of the contact elements runs essentially transversely with respect to the insertion direction, and the contact elements each have, between the central region and the end region, a corner directed away from the metal plate.

6. Shorting contact support according to claim 1, wherein the bridges are arranged with mirror-image symmetry with respect to one another in the wings.

7. Shorting contact support according to claim 1, comprising part of a plug connector with an igniter for a restraining system in a motor vehicle.

* * * * *